US011107435B2

(12) United States Patent
Kim et al.

(10) Patent No.: US 11,107,435 B2
(45) Date of Patent: Aug. 31, 2021

(54) DISPLAY APPARATUS AND METHOD OF DRIVING THE SAME

(71) Applicant: Samsung Display Co., Ltd., Yongin-si (KR)

(72) Inventors: Jongman Kim, Seoul (KR); Yong-Bum Kim, Suwon-si (KR); Dong-Hyun Yeo, Yongin-si (KR); Byung Kil Jeon, Hwaseong-si (KR); Woojung Jung, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 30 days.

(21) Appl. No.: 16/666,295

(22) Filed: Oct. 28, 2019

(65) Prior Publication Data

US 2020/0135137 A1 Apr. 30, 2020

(30) Foreign Application Priority Data

Oct. 30, 2018 (KR) ..... 10-2018-0130905

(51) Int. Cl.
*G09G 3/36* (2006.01)

(52) U.S. Cl.
CPC ..... *G09G 3/3696* (2013.01); *G09G 3/3688* (2013.01); *G09G 2320/028* (2013.01); *G09G 2354/00* (2013.01)

(58) Field of Classification Search
CPC ..... G09G 3/3696; G09G 3/3688; G09G 2320/028; G09G 2354/00
See application file for complete search history.

(56) References Cited

U.S. PATENT DOCUMENTS 9,161,025 B2 10/2015 Flynn
2009/0213050 A1* 8/2009 Hung ..... G09G 3/3611 345/87
2011/0221717 A1* 9/2011 Liu ..... G09G 3/3611 345/204

FOREIGN PATENT DOCUMENTS

KR 10-1336629 B1 12/2013
KR 10-2015-0093592 A 8/2015
KR 10-2019-0045439 A 5/2019

* cited by examiner

*Primary Examiner* — Peter D McLoone
(74) *Attorney, Agent, or Firm* — Lewis Roca Rothgerber Christie LLP

(57) ABSTRACT

A display apparatus includes a display panel, a position detector, a driving controller, a gate driver and a data driver. The display panel is configured to display an image. The position detector is configured to determine a position of a user. The driving controller is configured to generate an overdriving value according to a grayscale value of previous frame data and a grayscale value of present frame data. The gate driver is configured to output gate signals to the display panel. The data driver is configured to output data voltages to the display panel based on the overdriving value.

20 Claims, 9 Drawing Sheets

| VIEWING ANGLE | 0° | 20° | 40° |
|---|---|---|---|
| PARAMETER | 0.65(B1) | 0.22(B2) | 0.09(B3) |

FIG. 12

LUT

| | | DPF | | | | | | | | |
|---|---|---|---|---|---|---|---|---|---|---|
| | | 0 | 32 | 64 | 96 | 128 | 160 | 192 | 224 | 255 |
| DCF | 0 | D0D11 | D0D12 | ··· | | | | | | |
| | 32 | D0D21 | ⋱ | | | | | | | |
| | 64 | ⋮ | | | | | | | | |
| | 96 | | | | | | | | | |
| | 128 | | | | | | | | | |
| | 160 | | | | | | | | | |
| | 192 | | | | | | | | | |
| | 224 | | | | | | | | | |
| | 255 | | | | | | | | | D0D99 |

DISPLAY APPARATUS AND METHOD OF DRIVING THE SAME

CROSS-REFERENCE TO RELATED APPLICATION

This application claims priority to and the benefit of Korean Patent Application No. 10-2018-0130905, filed on Oct. 30, 2018 in the Korean Intellectual Property Office (KIPO), the content of which is incorporated herein in its entirety by reference.

BACKGROUND

1. Field

Exemplary embodiments of the present inventive concept relate to a display apparatus and a method of driving the display apparatus. More particularly, exemplary embodiments of the present inventive concept relate to a display apparatus generating an overdriving value varied according to a viewing angle and a method of driving the display apparatus.

2. Description of the Related Art

A display apparatus may include a display panel and a display panel driver. The display panel may include a plurality of gate lines, a plurality of data lines and a plurality of pixels. The display panel driver may include a gate driver and a data driver. The gate driver may output gate signals to the gate lines. The data driver may output data voltages to the data lines.

The display panel may include a lower substrate, an upper substrate and a liquid crystal layer disposed between the lower substrate and the upper substrate.

The display panel may be driven using a dynamic capacitance compensation ("DCC") method using previous frame data and present frame data to increase speed of response of liquid crystal molecules of the liquid crystal layer.

SUMMARY

Aspects of some exemplary embodiments of the present inventive concept are directed toward a display apparatus updating an overdriving value varied according to a viewing angle dependent on a position of a user to enhance a display quality of the display panel.

Aspects of some exemplary embodiments of the present inventive concept are directed toward a method of driving the above-mentioned display apparatus.

In an exemplary embodiment of a display apparatus according to the present inventive concept, the display apparatus includes a display panel, a position detector, a driving controller, a gate driver and a data driver. The display panel is configured to display an image. The position detector is configured to determine a position of a user. The driving controller is configured to generate an overdriving value according to a grayscale value of previous frame data and a grayscale value of present frame data. The gate driver is configured to output gate signals to the display panel. The data driver is configured to output data voltages to the display panel based on the overdriving value. The driving controller is further configured to receive a plurality of overdriving data of a plurality of viewing angles, determine a fixed parameter based on the plurality of overdriving data of the plurality of viewing angles, determine a viewing angle of the user based on the position of the user, determine a variable parameter based on the fixed parameter and the viewing angle, generate an overdriving reference line based on the fixed parameter and the variable parameter, receive shift overdriving data generated for a grayscale value which is different from the grayscale value of each of the plurality of overdriving data, determine a shift value of the overdriving reference line according to grayscale values based on the shift overdriving data and generate the overdriving value based on the overdriving reference line and a shifted overdriving reference line.

In an exemplary embodiment, the driving controller further include a position calculator configured to determine the viewing angle of the user based on the position of the user, an operator configured to determine the fixed parameter and the variable parameter, generate the overdriving reference line, determine the shift value of the overdriving reference line and generate the overdriving value and a memory configured to store an overdriving lookup table generated based on the overdriving reference line and the shifted overdriving reference line.

In an exemplary embodiment, the plurality of the overdriving data may include a first overdriving data group measured in a first viewing angle when the grayscale value of the previous frame data is a first grayscale value, a second overdriving data group measured in a second viewing angle when the grayscale value of the previous frame data is the first grayscale value and a third overdriving data group measured in a third viewing angle when the grayscale value of the previous frame data is the first grayscale value.

In an exemplary embodiment, the plurality of the overdriving data may further include a default overdriving data group measured regardless of the viewing angle when the grayscale value of the previous frame data is the first grayscale value.

In an exemplary embodiment, the first overdriving data group may include a first overdriving data measured in the first viewing angle when the grayscale value of the previous frame data is the first grayscale value and the grayscale value of the present frame data is a second grayscale value and a second overdriving data measured in the first viewing angle when the grayscale value of the previous frame data is the first grayscale value and the grayscale value of the present frame data is a third grayscale value. The default overdriving data group may include a third overdriving data measured when the grayscale value of the previous frame data is the first grayscale value and the grayscale value of the present frame data is the first grayscale value and a fourth overdriving data measured when the grayscale value of the previous frame data is the first grayscale value and the grayscale value of the present frame data is a maximum grayscale value.

In an exemplary embodiment, the overdriving reference line in the first viewing angle may be defined as Polynomial 1. The Polynomial 1 may be $DOD-DPF=A(DCF)^3+B1(DCF)^2+C(DCF)+D$. DOD is the overdriving value, DPF is the grayscale value of the previous frame data and DCF is the grayscale value of the present frame data. The operator may be configured to determine parameters A, B1, C and D in the Polynomial 1 utilizing the first overdriving data, the second overdriving data, the third overdriving data and the fourth overdriving data.

In an exemplary embodiment, the operator may be configured to determine the parameters A, C and D in the Polynomial 1 as the fixed parameters.

In an exemplary embodiment, the second overdriving data group may include a fifth overdriving data measured in the second viewing angle when the grayscale value of the previous frame data is the first grayscale value and the grayscale value of the present frame data is the second grayscale value and a sixth overdriving data measured in the second viewing angle when the grayscale value of the previous frame data is the first grayscale value and the grayscale value of the present frame data is the third grayscale value. The third overdriving data group may include a seventh overdriving data measured in the third viewing angle when the grayscale value of the previous frame data is the first grayscale value and the grayscale value of the present frame data is the second grayscale value and an eighth overdriving data measured in the third viewing angle when the grayscale value of the previous frame data is the first grayscale value and the grayscale value of the present frame data is the third grayscale value.

In an exemplary embodiment, the overdriving reference line in the second viewing angle may be defined as Polynomial 2. The Polynomial 2 may be $DOD-DPF=A(DCF)^3+B2(DCF)^2+C(DCF)+D$. The operator may be configured to determine a parameter B2 of the Polynomial 2 utilizing the fifth overdriving data and the sixth overdriving data and the fixed parameters A, C and D in Polynomial 1. The overdriving reference line in the third viewing angle may be defined as Polynomial 3. The Polynomial 3 is $DOD-DPF=A(DCF)^3+B3(DCF)^2+C(DCF)+D$. The operator may be configured to determine a parameter B3 of the Polynomial 3 utilizing the seventh overdriving data and the eighth overdriving data and the fixed parameters A, C and D in Polynomial 1.

In an exemplary embodiment, the operator may be further configured to determine parameters $\alpha$, $\beta$ and $\gamma$ representing relationships between the first viewing angle, B1 in the Polynomial 1, the second viewing angle, B2 in the Polynomial 2, the third viewing angle and B3 in the Polynomial 3.

In an exemplary embodiment, the operator may be further configured to determine the variable parameter according to the viewing angle utilizing Polynomial 4. The Polynomial 4 is $Y=\alpha X^2+\beta X+\gamma$. Y is the variable parameter and X is the viewing angle.

In an exemplary embodiment, the driving controller comprises an operator, and the operator may be configured to determine the shift value of the overdriving reference line based on the shift overdriving data measured in the first viewing angle when the grayscale value of the previous frame data is a fourth grayscale value and the grayscale value of the present frame data is a fifth grayscale value.

In an exemplary embodiment, the driving controller comprises an operator, and the operator may be configured to determine the shift value of the overdriving reference line based on a first shift overdriving data, a second shift overdriving data and a third shift overdriving data. The first shift overdriving data may be measured in the first viewing angle when the grayscale value of the previous frame data is a fourth grayscale value and the grayscale value of the present frame data is a fifth grayscale value. The second shift overdriving data may be measured in the second viewing angle when the grayscale value of the previous frame data is the fourth grayscale value and the grayscale value of the present frame data is the fifth grayscale value. The third shift overdriving data may be measured in the third viewing angle when the grayscale value of the previous frame data is the fourth grayscale value and the grayscale value of the present frame data is the fifth grayscale value.

In an exemplary embodiment, the driving controller may be configured to determine the viewing angle of the user based on the position of the user in real time. The driving controller may be configured to update the variable parameter, the overdriving reference line and the overdriving value based on the viewing angle of the user in real time.

In an exemplary embodiment of a method of driving a display apparatus according to the present inventive concept, the method includes determining a fixed parameter based on a plurality of overdriving data of a plurality of viewing angles, determining a position of a user with respect to a display panel, determining a viewing angle of the user based on the position of the user, determining a variable parameter based on the fixed parameter and the viewing angle, generating an overdriving reference line based on the fixed parameter and the variable parameter, determining a shift value of the overdriving reference line according to grayscale values based on shift overdriving data generated for a grayscale value which is different from the grayscale value of each of the plurality of overdriving data, generating an overdriving value based on the overdriving reference line and a shifted overdriving reference line, generating a data voltage based on the overdriving value and outputting the data voltage to the display panel.

In an exemplary embodiment, the plurality of overdriving data may include a first overdriving data group measured in a first viewing angle when the grayscale value of a previous frame data is a first grayscale value, a second overdriving data group measured in a second viewing angle when the grayscale value of the previous frame data is the first grayscale value, a third overdriving data group measured in a third viewing angle when the grayscale value of the previous frame data is the first grayscale value and a default overdriving data group measured regardless of the viewing angle when the grayscale value of the previous frame data is the first grayscale value.

In an exemplary embodiment, the first overdriving data group may include a first overdriving data measured in the first viewing angle when the grayscale value of the previous frame data is the first grayscale value and the grayscale value of a present frame data is a second grayscale value and a second overdriving data measured in the first viewing angle when the grayscale value of the previous frame data is the first grayscale value and the grayscale value of the present frame data is a third grayscale value. The default overdriving data group may include a third overdriving data measured when the grayscale value of the previous frame data is the first grayscale value and the grayscale value of the present frame data is the first grayscale value and a fourth overdriving data measured when the grayscale value of the previous frame data is the first grayscale value and the grayscale value of the present frame data is a maximum grayscale value.

In an exemplary embodiment, the overdriving reference line in the first viewing angle may be defined as Polynomial 1. The Polynomial 1 may be $DOD-DPF=A(DCF)^3+B1(DCF)^2+C(DCF)+D$. DOD is the overdriving value, DPF is the grayscale value of the previous frame data and DCF is the grayscale value of the present frame data. Parameters A, B1, C and D in the Polynomial 1 may be determined utilizing the first overdriving data, the second overdriving data, the third overdriving data and the fourth overdriving data.

In an exemplary embodiment, the second overdriving data group may include a fifth overdriving data measured in the second viewing angle when the grayscale value of the previous frame data is the first grayscale value and the grayscale value of the present frame data is the second grayscale value and a sixth overdriving data measured in the second viewing angle when the grayscale value of the previous frame data is the first grayscale value and the grayscale value of the present frame data is the third grayscale value. The third overdriving data group may include a seventh overdriving data measured in the third viewing angle when the grayscale value of the previous frame data is the first grayscale value and the grayscale value of the present frame data is the second grayscale value and an eighth overdriving data measured in the third viewing angle when the grayscale value of the previous frame data is the first grayscale value and the grayscale value of the present frame data is the third grayscale value. The overdriving reference line in the second viewing angle may be defined as Polynomial 2. The Polynomial 2 may be $DOD-DPF=A(DCF)^3+B2(DCF)^2+C(DCF)+D$. A parameter B2 of the Polynomial 2 may be determined utilizing the fifth overdriving data and the sixth overdriving data and the fixed parameters A, C and D in Polynomial 1. The overdriving reference line in the third viewing angle may be defined as Polynomial 3. The Polynomial 3 may be $DOD-DPF=A(DCF)^3+B3(DCF)^2+C(DCF)+D$. A parameter B3 of the Polynomial 3 may be determined utilizing the seventh overdriving data and the eighth overdriving data and the fixed parameters A, C and D in Polynomial 1.

In an exemplary embodiment, the variable parameter according to the viewing angle may be determined utilizing Polynomial 4. The Polynomial 4 may be $Y=\alpha X^2+\beta X+\gamma$. Y is the variable parameter and X is the viewing angle. Parameters $\alpha$, $\beta$ and $\gamma$ may represent relationships between the first viewing angle, B1 in the Polynomial 1, the second viewing angle, B2 in the Polynomial 2, the third viewing angle and B3 in the Polynomial 3.

According to the display apparatus and the method of driving the display apparatus, a plurality of overdriving data in a plurality of viewing angles is inputted to determine a fixed parameter, a position of a user with respect to the display panel is determined, the viewing angle of the user is determined based on the position of the user, a variable parameter is determined based on the fixed parameter and the viewing angle, an overdriving reference line is determined based on the fixed parameter and the variable parameter, shift overdriving data is generated for a grayscale value which is different from the grayscale value of the plurality of overdriving data and is inputted to determine a shift value of the overdriving reference line, the overdriving value is determined using the overdriving reference line and the shifted overdriving reference line, and the data voltage is generated based on the overdriving value. Thus, the overdriving value may be automatically determined according to the viewing angle of the user so that the display quality of the display panel may be enhanced.

The user may select the overdriving value so that the display quality may be improved for or optimized to the user. The user may select the overdriving values three times, seven times or nine times to optimize or improve the display quality according to the exemplary embodiments.

BRIEF DESCRIPTION OF THE DRAWINGS

The features and advantages of the present inventive concept will become more apparent from the following detailed description taken in conjunction with the accompanying drawings.

FIG. 12 is a table illustrating an exemplary overdriving lookup table stored in a memory of FIG. 2.

DETAILED DESCRIPTION

Hereinafter, the present inventive concept will be explained in more detail with reference to the accompanying drawings.

Figure 1:
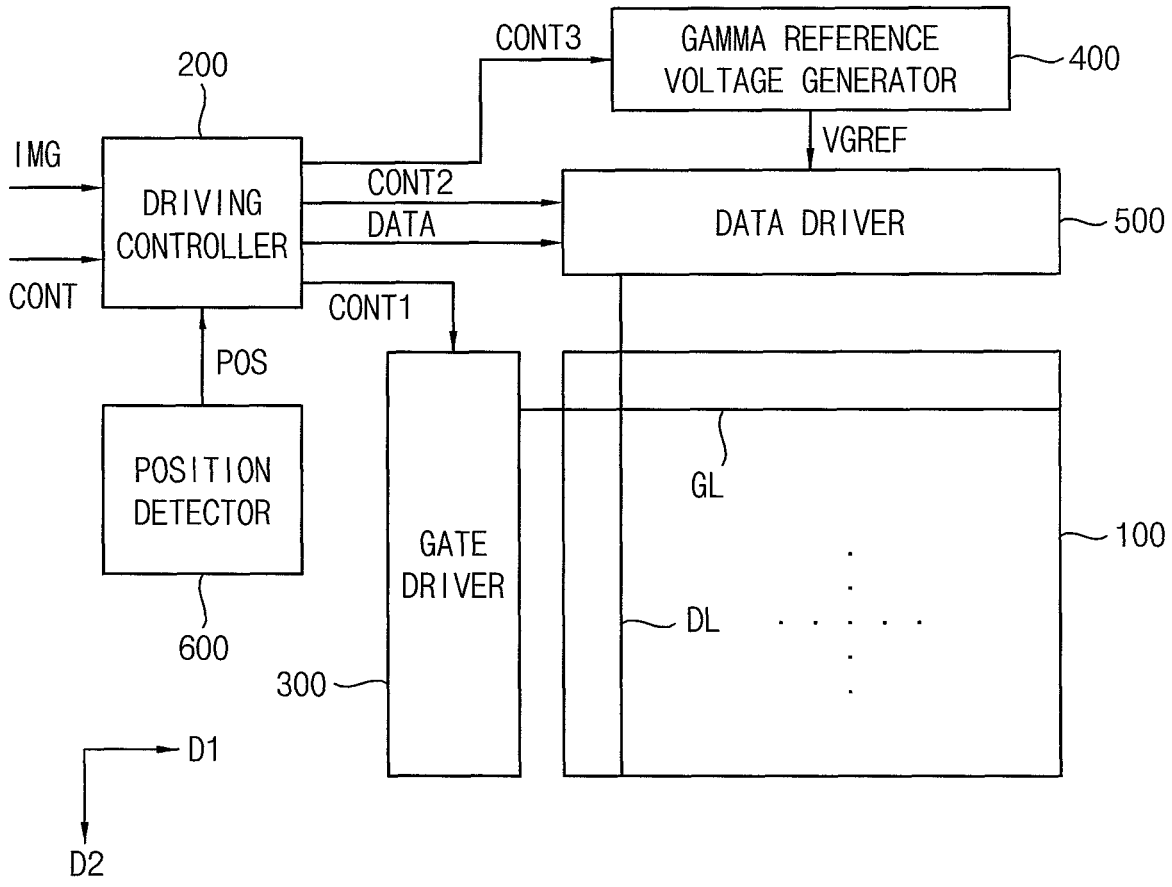
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus may include a display panel 100 and a display panel driver. The display panel driver may include a driving controller 200, a gate driver 300, a gamma reference voltage generator 400 and a data driver 500. The display apparatus may further include a position detector 600.

The display panel 100 may include a display region and a peripheral region adjacent to the display region.

The display panel 100 may include a plurality of gate lines GL, a plurality of data lines DL and a plurality of pixels electrically connected to the gate lines GL and the data lines DL. The gate lines GL may extend in a first direction D1, and the data lines DL may extend in a second direction D2 crossing or intersecting the first direction D1.

The driving controller 200 may receive input image data IMG and an input control signal CONT from an external apparatus. The input image data IMG may include red image data, green image data, and blue image data. The input image data IMG may include white image data. The input image data IMG may include magenta image data, yellow image data, and cyan image data. The input control signal CONT may include a master clock signal and a data enable signal. The input control signal CONT may further include a vertical synchronizing signal and a horizontal synchronizing signal.

The driving controller 200 may generate a first control signal CONT1, a second control signal CONT2, a third control signal CONT3 and a data signal DATA based on the input image data IMG and the input control signal CONT.

The driving controller 200 may generate the first control signal CONT1 for controlling an operation of the gate driver 300 based on the input control signal CONT, and may output the first control signal CONT1 to the gate driver 300. The first control signal CONT1 may include a vertical start signal and a gate clock signal.

The driving controller 200 may generate the second control signal CONT2 for controlling an operation of the data driver 500 based on the input control signal CONT, and may output the second control signal CONT2 to the data driver 500. The second control signal CONT2 may include a horizontal start signal and a load signal.

The driving controller 200 may generate the data signal DATA based on the input image data IMG. The driving controller 200 may output the data signal DATA to the data driver 500.

In the present exemplary embodiment, the driving controller 200 may generate an overdriving value according to a grayscale value (gray level value) of a previous frame data and/or a grayscale value (gray level value) of a present frame data. The driving controller 200 may generate the data signal DATA based on the overdriving value.

The driving controller 200 may generate the third control signal CONT3 for controlling an operation of the gamma reference voltage generator 400 based on the input control signal CONT, and outputs the third control signal CONT3 to the gamma reference voltage generator 400.

The gate driver 300 may generate gate signals driving the gate lines GL in response to the first control signal CONT1 received from the driving controller 200. For example, the gate driver 300 may sequentially output the gate signals to the gate lines GL.

The gamma reference voltage generator 400 may generate a gamma reference voltage VGREF in response to the third control signal CONT3 received from the driving controller 200. The gamma reference voltage generator 400 may provide the gamma reference voltage VGREF to the data driver 500. The gamma reference voltage VGREF has a value corresponding to a level of the data signal DATA.

In an exemplary embodiment, the gamma reference voltage generator 400 may be in the driving controller 200 or may be in the data driver 500.

The data driver 500 may receive the second control signal CONT2 and the data signal DATA from the driving controller 200, and may receive the gamma reference voltages VGREF from the gamma reference voltage generator 400. The data driver 500 may convert the data signal DATA into data voltages having or being an analog type using the gamma reference voltages VGREF. The data driver 500 may output the data voltages to the data lines DL.

The position detector 600 may determine a position POS of a user with respect to the display panel 100. The position detector 600 may include an eye tracker determining positions of eyes of the user or a head tracker determining a position of a head of the user. The position detector 600 may output the position POS of the user to the driving controller 200. For example, when the position detector 600 includes the eye tracker, the position POS of the user may be determined by a central point of two eyes of the user.

Figure 2:
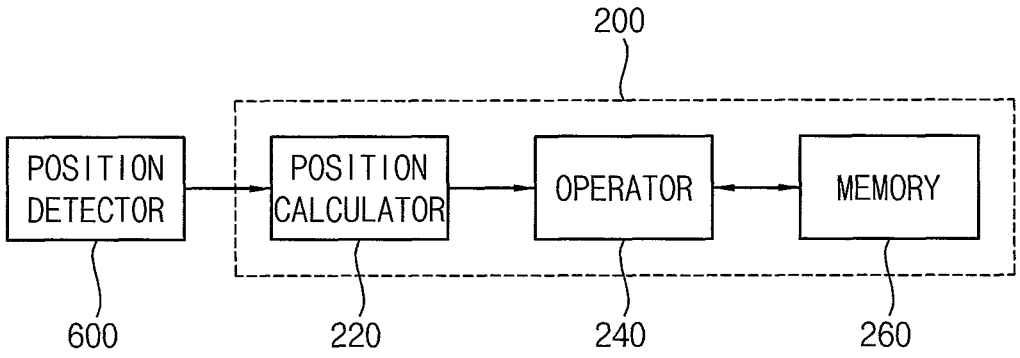
FIG. 2 is a block diagram illustrating a position detector and a driving controller of FIG. 1.

FIG. 2 is a block diagram illustrating the position detector 600 and the driving controller 200 of FIG. 1.

The explanation of the operation of the driving controller 200 in FIG. 2 is limited to the overdriving operation determining the overdriving value based on the grayscale value (gray level value) of the previous frame data and the grayscale value (gray level value) of the present frame data.

Referring to FIGS. 1-2, the driving controller 200 may receive a plurality of overdriving data P11, P12, P13, P21, P22 and P23 in a plurality of viewing angles. The driving controller 200 may determine the fixed parameters A, C, D, α, β and γ based on the plurality of the overdriving data P11, P12, P13, P21, P22 and P23 in the plurality of the viewing angles. The driving controller 200 may determine the viewing angle X of the user based on the position POS of the user. The driving controller 200 may determine the variable parameter Y based on the fixed parameters A, C, D, α, β and γ and the viewing angle X of the user. The driving controller 200 may determine an overdriving reference line BLY based on the fixed parameters A, C, D, α, β and γ and the variable parameter Y. A shift value Δx of the overdriving reference line BLY is determined based on shift overdriving data P5 generated for a grayscale value (gray level value) which is different from the grayscale value (gray level value) of each of the plurality of overdriving data P11, P12, P13, P21, P22 and P23. The shift value Δx of the overdriving reference line BLY is varied according to the grayscale value (gray level value).

The driving controller 200 may include a position calculator 220, an operator 240 and a memory 260.

The position calculator 220 may receive the position POS of the user from the position detector 600. The position calculator 220 may determine the viewing angle of the user based on the position POS of the user. For example, when the user is positioned in front of a central portion of the display panel 100, the viewing angle may be zero degree. The viewing angle of the user may be defined as an angle between a perpendicular or normal line extending from the central point of the display panel 100 and a line connecting the position POS of the user and the central point of the display panel 100. For example, the viewing angle may be limited in a horizontal direction. Alternatively, the viewing angle may be determined by a combined angle of a horizontal viewing angle and a vertical viewing angle.

The operator 240 may determine the fixed parameters A, C, D, α, β and γ, the variable parameter Y, generate the overdriving reference line BLY, determine the shift value Δx of the overdriving reference line BLY and generate the overdriving value DOD.

The memory 260 may store the overdriving lookup table LUT generated based on the overdriving reference line BLY and the shifted overdriving reference line. In addition, the memory 260 may store the fixed parameters A, C, D, α, β and γ, the viewing angle X of the user and the variable parameter Y. In addition, the memory 260 may further store the overdriving data P11, P12, P13, P21, P22, P23, P3, P4 and P5.

Figure 3:
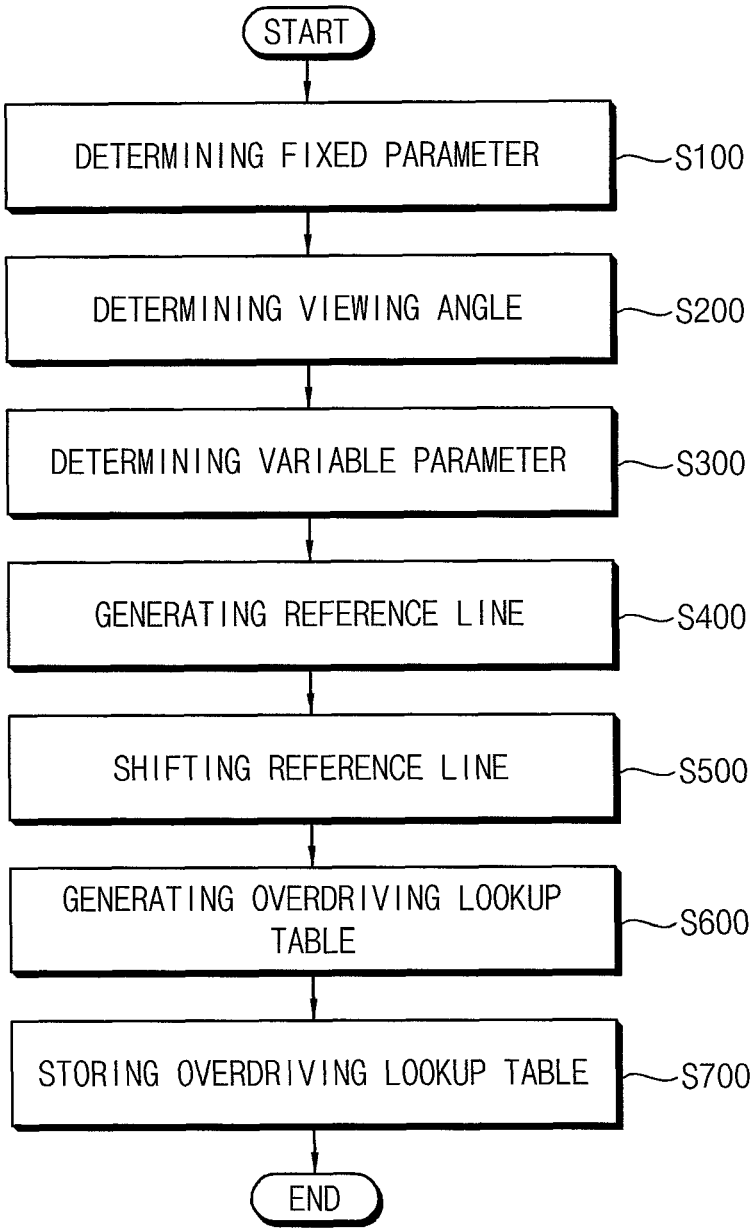
FIG. 3 is a flowchart diagram illustrating a method of driving the display panel of FIG. 1 using an overdriving method.
Figure 4:
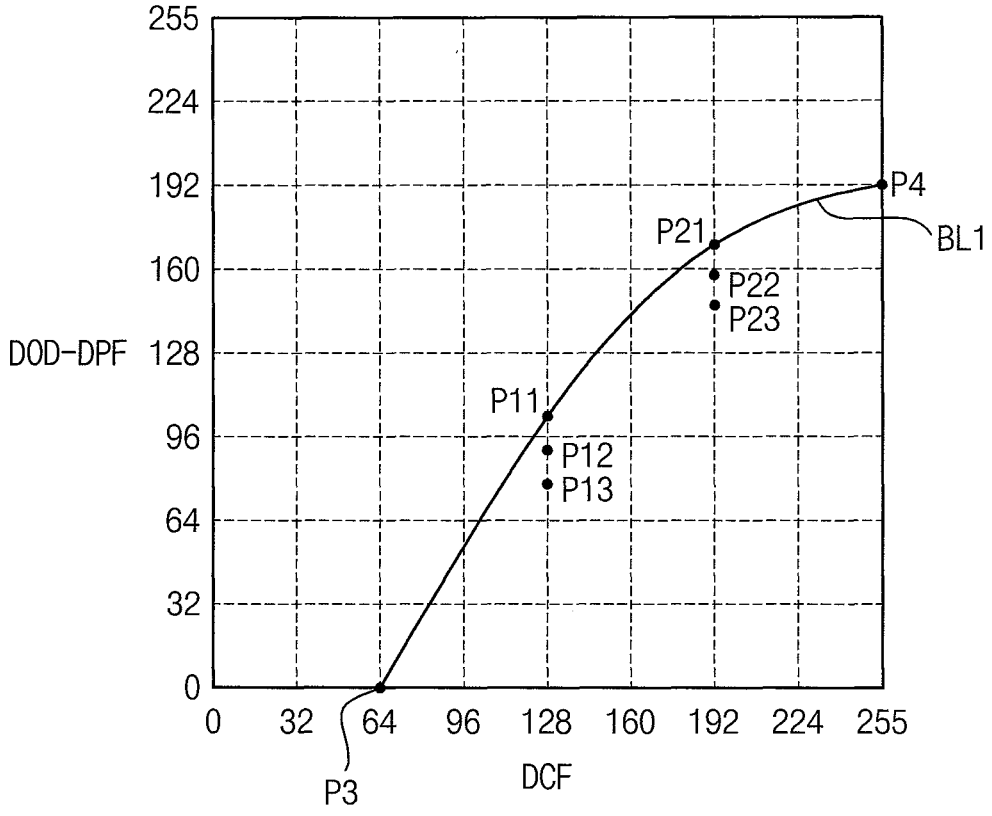
FIGS. 4-6 are graphs illustrating a method of determining fixed parameters by an operator of FIG. 2.
Figure 5:
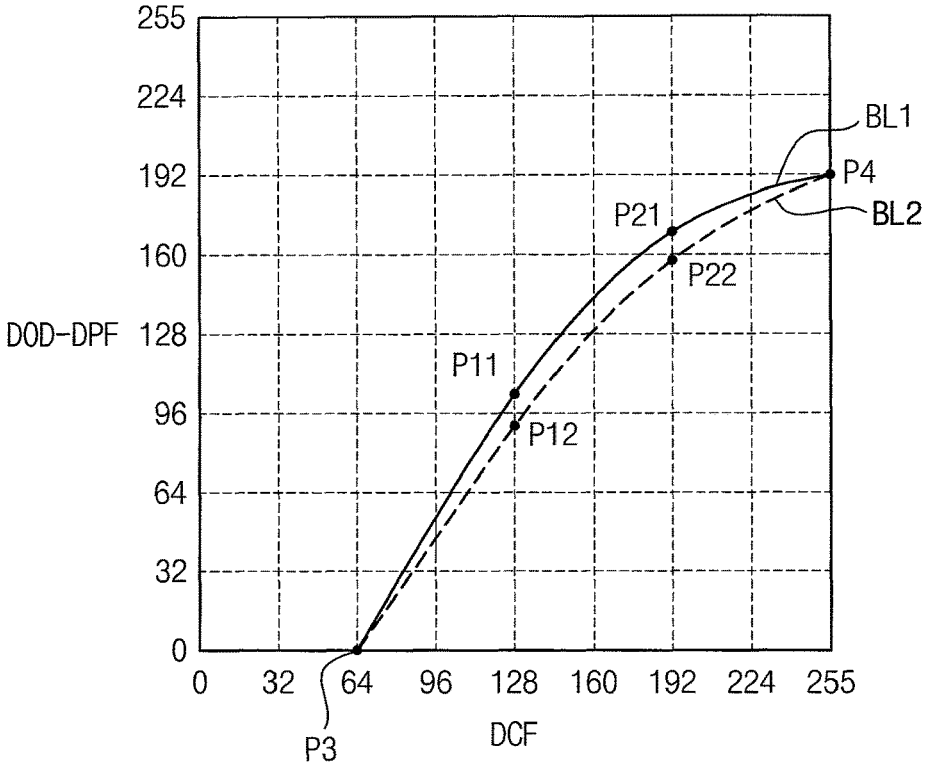
Figure 6:
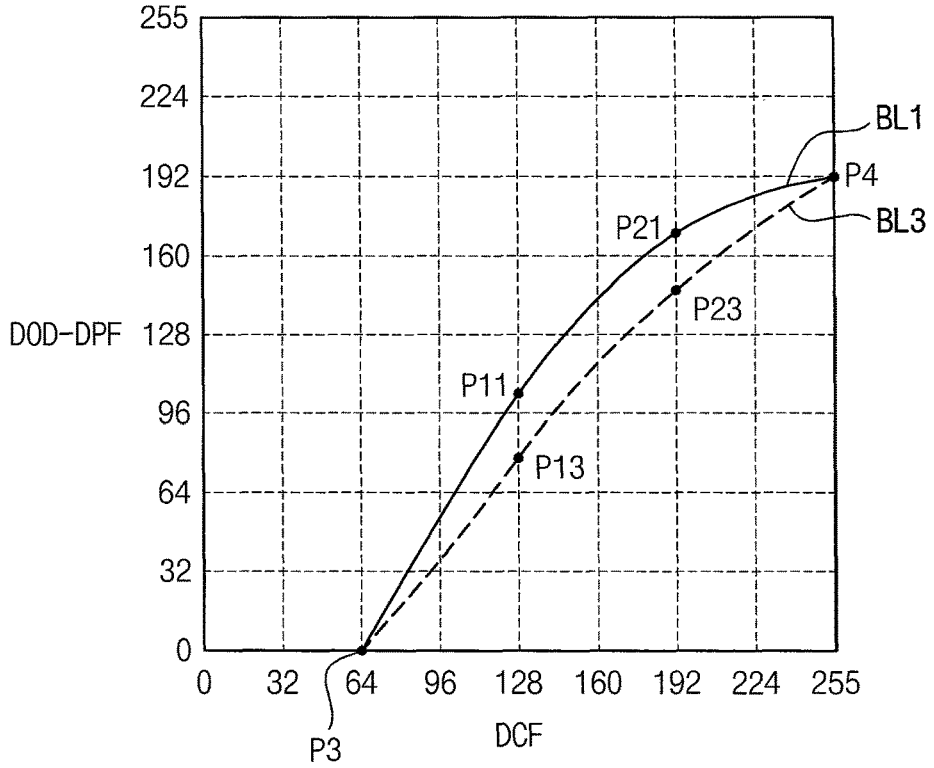
Figures 7, 8:
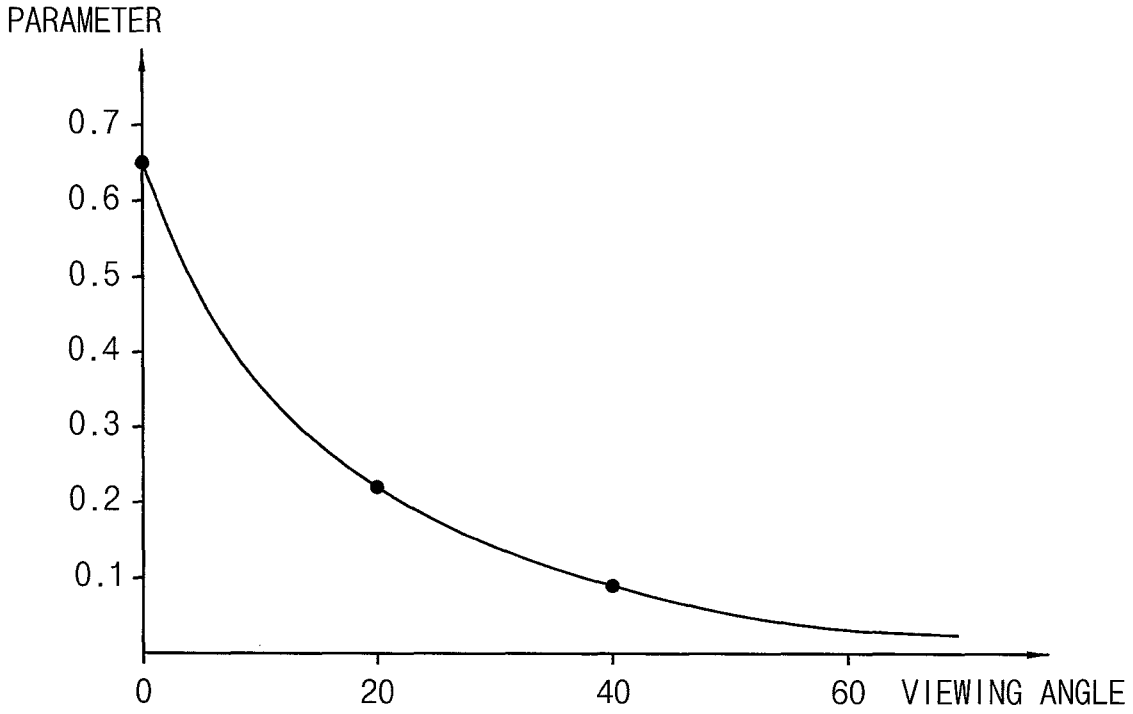
FIG. 7 is a table illustrating the method of determining fixed parameters by the operator of FIG. 2.
FIG. 8 is a graph illustrating a method of determining a variable parameter by the operator of FIG. 2.

FIG. 3 is a flowchart diagram illustrating a method of driving the display panel 100 of FIG. 1 using the overdriving method. FIGS. 4-6 are graphs illustrating a method of determining the fixed parameter by the operator 240 of FIG. 2. FIG. 7 is a table illustrating the method of determining the fixed parameter by the operator 240 of FIG. 2.

Referring to FIGS. 1-7, the operator 240 may receive the plurality of the overdriving data P11, P12, P13, P21, P22, P23, P3 and P4 of the plurality of the viewing angles. The operator 240 may determine the fixed parameters A, C, D, α, β and γ based on the plurality of the overdriving data P11, P12, P13, P21, P22, P23, P3 and P4 of the plurality of the viewing angles (act S100).

The plurality of the overdriving data may include a first overdriving data group P11 and P21 measured when the grayscale value (gray level value) DPF of the previous frame data is a first grayscale value (64 in FIG. 4) and the viewing angle is a first viewing angle (e.g. zero degree), a second overdriving data group P12 and P22 measured when the grayscale value (gray level value) DPF of the previous frame data is the first grayscale value (64 in FIG. 4) and the viewing angle is a second viewing angle (e.g. twenty degree), a third overdriving data group P13 and P23 measured when the grayscale value (gray level value) DPF of the previous frame data is the first grayscale value (64 in FIG. 4) and the viewing angle is a third viewing angle (e.g. forty degree) and a default overdriving data group P3 and P4 measured regardless of the viewing angle when the grayscale value DPF of the previous frame data is the first grayscale value (64 in FIG. 4).

For example, the first overdriving data group P11 and P21 may include a first overdriving data P11 measured when the grayscale value DPF of the previous frame data is the first grayscale value (64 in FIG. 4), the grayscale value DCF of the present frame data is a second grayscale value (128 in FIG. 4) and the viewing angle is the first viewing angle (e.g. zero degree) and a second overdriving data P21 measured when the grayscale value DPF of the previous frame data is the first grayscale value (64 in FIG. 4), the grayscale value DCF of the present frame data is a third grayscale value (192 in FIG. 4) and the viewing angle is the first viewing angle (e.g. zero degree).

The first overdriving data group P11 and P21 may be determined to eliminate a transition area of an overdriving setting pattern by the user after the overdriving setting pattern is shown to the user in the first viewing angle (e.g. zero degree).

For example, the second overdriving data group P12 and P22 may include a fifth overdriving data P12 measured when the grayscale value DPF of the previous frame data is the first grayscale value (64 in FIG. 4), the grayscale value DCF of the present frame data is a second grayscale value (128 in FIG. 4) and the viewing angle is the second viewing angle (e.g. twenty degree) and a sixth overdriving data P22 measured when the grayscale value DPF of the previous frame data is the first grayscale value (64 in FIG. 4), the grayscale value DCF of the present frame data is the third grayscale value (192 in FIG. 4) and the viewing angle is the second viewing angle (e.g. twenty degree).

The second overdriving data group P12 and P22 may be determined to eliminate a transition area of an overdriving setting pattern by the user after the overdriving setting pattern is shown to the user in the second viewing angle (e.g. twenty degree).

For example, the third overdriving data group P13 and P23 may include a seventh overdriving data P13 measured when the grayscale value (gray level value) DPF of the previous frame data is the first grayscale value (64 in FIG. 4), the grayscale value DCF of the present frame data is a second grayscale value (128 in FIG. 4) and the viewing angle is the third viewing angle (e.g. forty degree) and an eighth overdriving data P23 measured when the grayscale value DPF of the previous frame data is the first grayscale value (64 in FIG. 4), the grayscale value DCF of the present frame data is the third grayscale value (192 in FIG. 4) and the viewing angle is the third viewing angle (e.g. forty degree).

The third overdriving data group P13 and P23 may be determined to eliminate a transition area of an overdriving setting pattern by the user after the overdriving setting pattern is shown to the user in the third viewing angle (e.g. forty degree).

Although the second overdriving data group P12 and P22 and the third overdriving data group P13 and P23 are directly set by the user in the present exemplary embodiment, the present inventive concept is not limited thereto. For example, the user may set only the first overdriving data group P11 and P21, the second overdriving data group P12 and P22 and the third overdriving data group P13 and P23 may be automatically determined based on viewing angle characteristics of the display panel 100.

The default overdriving data group P3 and P4 may include a third overdriving data P3 measured when the grayscale value DPF of the previous frame data is the first grayscale value (64 in FIG. 4) and the grayscale value DCF of the present frame data is the first grayscale value (64 in FIG. 4) same as the grayscale value DPF of the previous frame data and a fourth overdriving data P4 measured when the grayscale value DPF of the previous frame data is the first grayscale value (64 in FIG. 4) and the grayscale value DCF of the present frame data is the maximum grayscale value (255 in FIG. 4).

In the third overdriving data P3, the grayscale value DPF of the previous frame data is same as the grayscale value DCF of the present frame data so that the overdriving is not required. Thus, the overdriving value DOD of the third overdriving data P3 may be 64 (e.g. DOD−DPF=64−64=0)

In the fourth overdriving data P4, the grayscale value DCF of the present frame data is the maximum grayscale value (maximum gray level value), the overdriving value DOD of the fourth overdriving data P4 may be 255 which is the maximum value of the grayscale (gray level) data (e.g. DOD−DPF=255−64=191).

As shown in FIG. 4, the overdriving reference line BL1 in the first viewing angle (e.g. zero degree) may be defined as following Polynomial 1.

$$DOD-DPF=A(DCF)^3+B1(DCF)^2+C(DCF)+D \quad \text{Polynomial 1}$$

Herein, DOD is the overdriving value, DPF is the grayscale value of the previous frame data and DCF is the grayscale value of the present frame data.

The operator 240 may determine parameters A, B1, C, and D of the Polynomial 1 using the first overdriving data P11, the second overdriving data P21, the third overdriving data P3 and the fourth overdriving data P4. Polynomial 1 includes four parameters A, B1, C, and D and four overdriving data P11, P21, P3, and P4 are provided so that four parameters A, B1, C, and D may be determined using four overdriving data P11, P21, P3, and P4.

The operator 240 may determine the fixed parameters A, C, and D from among the parameters A, B1, C, and D. The operator 240 may store the fixed parameters A, C, and D to the memory 260.

As shown in FIG. 5, the overdriving reference line BL2 in the second viewing angle (e.g. twenty degree) may be defined as following Polynomial 2.

$$DOD-DPF=A(DCF)^3+B2(DCF)^2+C(DCF)+D \quad \text{Polynomial 2}$$

The operator 240 may determine a parameter B2 of the Polynomial 2 using the fifth overdriving data P12 and the sixth overdriving data P22 and the fixed parameters A, C and D. Herein, the fixed parameters A, C and D may be same as the fixed parameters A, C and D in Polynomial 1.

As shown in FIG. 6, the overdriving reference line BL3 in the third viewing angle (e.g. forty degree) may be defined as following Polynomial 3.

$$DOD-DPF=A(DCF)^3+B3(DCF)^2+C(DCF)+D \quad \text{Polynomial 3}$$

The operator 240 may determine a parameter B3 of the Polynomial 3 using the seventh overdriving data P13 and the eighth overdriving data P23 and the fixed parameters A, C and D. Herein, the fixed parameters A, C and D may be same as the fixed parameters A, C and D in Polynomial 1.

The operator 240 may further determine the fixed parameters α, β and γ representing relationships between the first viewing angle, B1 in Polynomial 1, the second viewing angle, B2 in Polynomial 2, the third viewing angle, and B3 in Polynomial 3. The operator 240 may store the fixed parameters α, β and γ to the memory 260.

Figure 9:
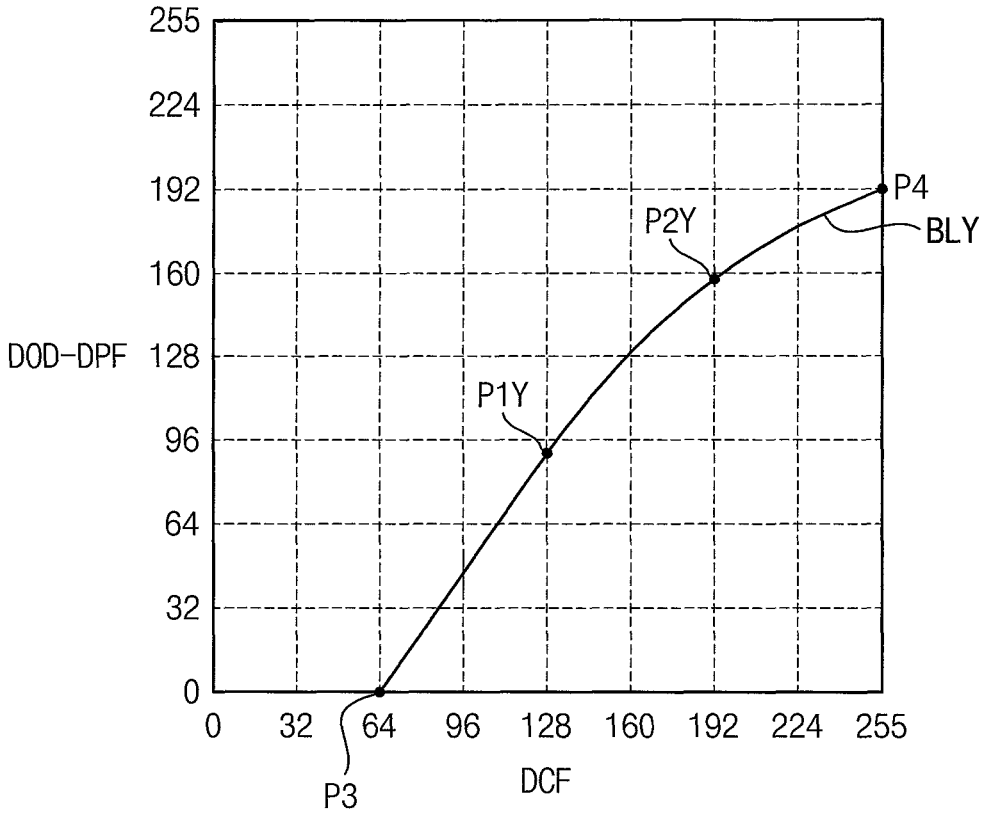
FIG. 9 is a graph illustrating the method of determining the variable parameter by the operator of FIG. 2.

FIG. 8 is a graph illustrating a method of determining a variable parameter Y by the operator 240 of FIG. 2. FIG. 9 is a graph illustrating the method of determining the variable parameter Y by the operator 240 of FIG. 2.

Referring to FIGS. 1-9, the position detector 600 determines the position POS of the user with respect to the display panel 100. The position calculator 220 determines the viewing angle X of the user based on the position POS of the user (act S200).

The operator 240 determines the variable parameter Y based on the fixed parameters α, β and γ and the viewing angle X (act S300). The operator 240 may determine the variable parameter Y according to the viewing angle X using following Polynomial 4. The operator 240 may store the variable parameter Y to the memory 260.

$$Y=\alpha X^2+\beta X+\gamma \quad \text{Polynomial 4}$$

Herein, Y is the variable parameter and X is the viewing angle. α, β and γ are parameters representing relationships between the first viewing angle, B1 in Polynomial 1, the second viewing angle, B2 in Polynomial 2, the third viewing angle, and B3 in Polynomial 3.

After the variable parameter Y according to the viewing angle X is determined using Polynomial 4, the overdriving reference line BLY to which the viewing angle X is applied is determined using following Polynomial 5 (act S400).

$$DOD-DPF=A(DCF)^3+Y(DCF)^2+C(DCF)+D \quad \text{Polynomial 5}$$

Figure 10:
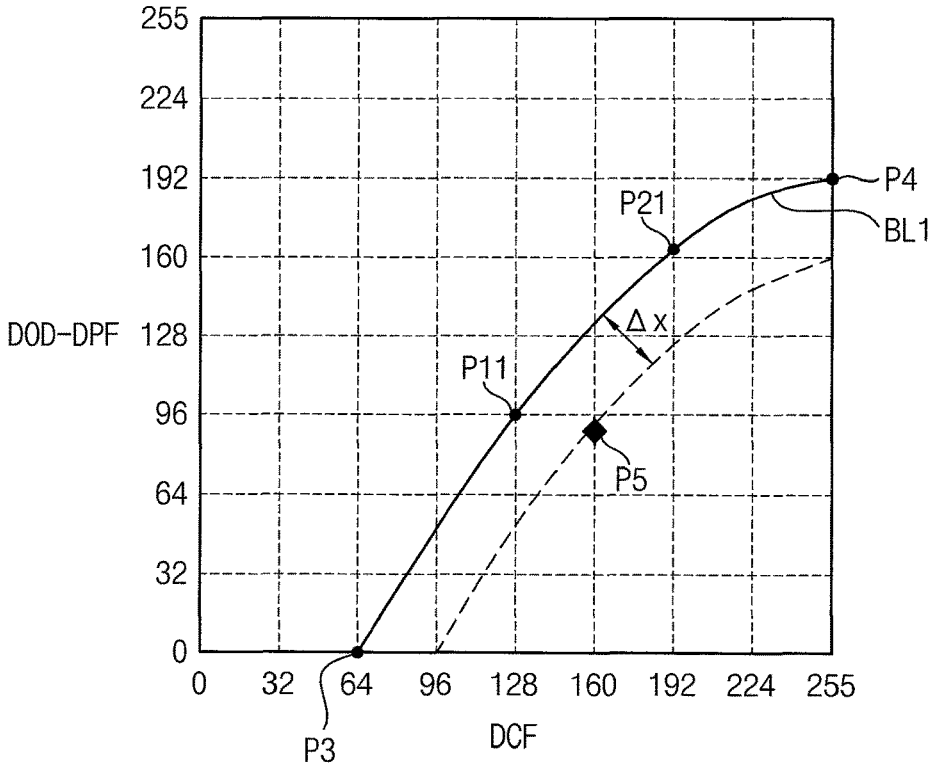
FIG. 10 is a graph illustrating a method of determining a shift value of an overdriving reference line by the operator of FIG. 2.
Figure 11:
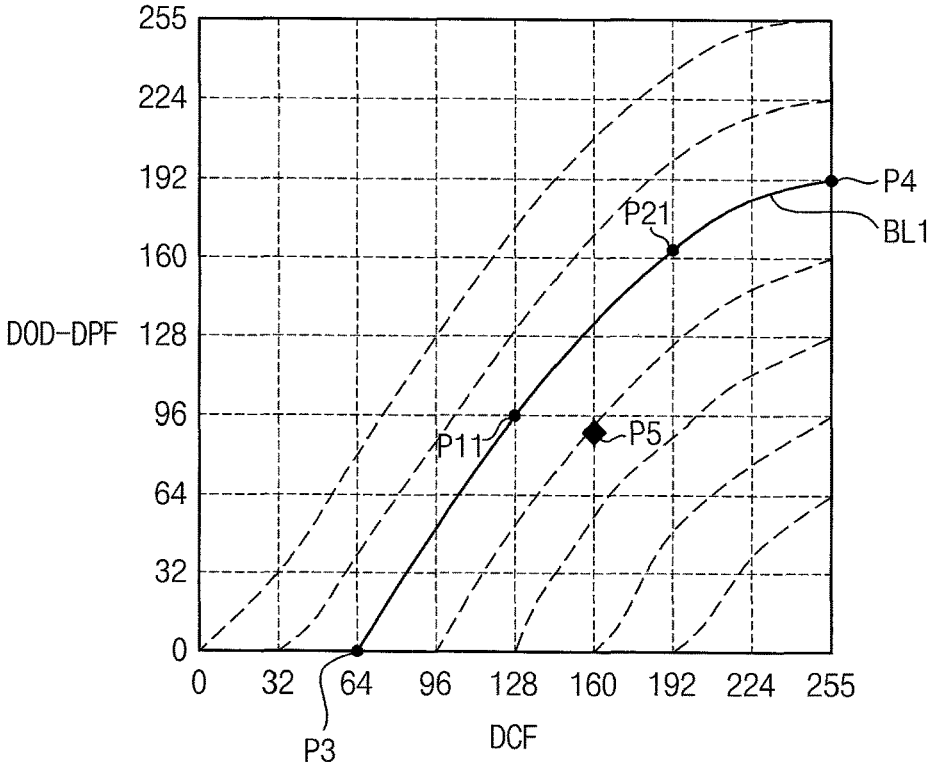
FIG. 11 is a graph illustrating the overdriving reference line and a shifted overdriving reference line generated by the operator of FIG. 2.

FIG. 10 is a graph illustrating a method of determining the shift value of the overdriving reference line by the operator 240 of FIG. 2. FIG. 11 is a graph illustrating the overdriving reference line and a shifted overdriving reference line generated by the operator 240 of FIG. 2.

Referring to FIGS. 1-11, the operator 240 receives the shift overdriving data P5 which is generated for a grayscale value (gray level value) which is different from the grayscale value (gray level value) of each of the plurality of overdriving data P11, P12, P13, P21, P22 and P23. The operator 240 generates the shift value Δx of the overdriving reference line BLY varied according to the grayscale value based on the shift overdriving data P5.

When the grayscale value DPF of the previous frame data is a fourth grayscale value (96 in FIG. 10) and the grayscale value DCF of the present frame data is a fifth grayscale value (160 in FIG. 10), the operator 240 may determine the shift value Δx of the overdriving reference line BLY based on the shift overdriving data P5 which is measured in the first viewing angle (e.g. zero degree).

The shift of the overdriving reference line BLY may be represented as following Polynomial 6.

$$DOD-DPF=A(DCF-\Delta x)^3+Y(DCF-\Delta x)^2+C(DCF-\Delta x)+D \quad \text{Polynomial 6}$$

Although the shift value Δx is represented as a parallel transference in an X-axis for convenience of explanation in Polynomial 6, the present inventive concept is not limited thereto. As shown in FIG. 10, the shift value Δx may represent transference in a direction perpendicular to an extending direction of the overdriving reference line BLY.

After the shift value Δx is determined, the overdriving reference line BLY of FIG. 9 may be shifted by the shift value Δx (act S500).

When the grayscale value (gray level value) DPF of the previous frame data is different from 64 grayscale (gray level value 64) in FIG. 10, the operator 240 may determine the overdriving value based on the shifted overdriving reference line shifted by the shift value Δx as shown in FIG. 11.

In an exemplary embodiment, the operator 240 may shift the overdriving reference line using the shift values measured at the various viewing angles. For example, the operator 240 may determine the shift value Δx of the overdriving reference line BLY using a first shift overdriving data, a second shift overdriving data and a third shift overdriving data. The first shift overdriving data may be measured in the first viewing angle when the grayscale value DPF of the previous frame data is the fourth grayscale value (96 in FIG. 10) and the grayscale value DCF of the present frame data is the fifth grayscale value (160 in FIG. 10). The second shift overdriving data may be measured in the second viewing angle when the grayscale value DPF of the previous frame data is the fourth grayscale value (96 in FIG. 10) and the grayscale value DCF of the present frame data is the fifth grayscale value (160 in FIG. 10). The third shift overdriving data may be measured in the third viewing angle when the grayscale value DPF of the previous frame data is the fourth grayscale value (96 in FIG. 10) and the grayscale value DCF of the present frame data is the fifth grayscale value (160 in FIG. 10).

FIG. 12 is a table illustrating an exemplary overdriving lookup table LUT stored in the memory 260 of FIG. 2.

Referring to FIGS. 1-12, the operator 240 may generate the overdriving values according to the grayscale values in a lookup table LUT (act S600).

The operator 240 may store the overdriving lookup table LUT to the memory 260 (act S700).

The overdriving lookup table LUT may include a first axis representing the grayscale value DPF of the previous frame data, a second axis representing the grayscale value DCF of the present frame data and the overdriving value DOD corresponding to the grayscale value DPF of the previous frame data and the grayscale value DCF of the present frame data.

For example, when the grayscale value DPF of the previous frame data is zero and the grayscale value DCF of the present frame data is zero, a first overdriving value DOD11 corresponding to zero and zero is stored in the lookup table. For example, when the grayscale value DPF of the previous frame data is zero and the grayscale value DCF of the present frame data is 32, a second overdriving value DOD21 corresponding to zero and 32 is stored in the lookup table. For example, when the grayscale value DPF of the previous frame data is 32 and the grayscale value DCF of the present frame data is zero, a third overdriving value DOD12 corresponding to 32 and zero is stored in the lookup table.

The overdriving values corresponding to a grayscale value greater than zero and less than 32 may be determined by interpolation.

The driving controller 200 may determine the viewing angle of the user based on the position POS of the user in real time. The driving controller 200 may update the variable parameter Y, the overdriving reference line BLY, the overdriving value, and the overdriving lookup table LUT based on the viewing angle of the user in real time.

According to the present exemplary embodiment, the plurality of the overdriving data P11, P12, P13, P21, P22, P23, P3 and P4 in the plurality of the viewing angles is inputted to determine the fixed parameters A, C, D, α, β and γ, the position POS of the user with respect to the display panel 100 is determined, the viewing angle X of the user is determined based on the position POS of the user, the variable parameter Y is determined based on the fixed parameters A, C, D, α, β and γ and the viewing angle X, the overdriving reference line BLY is determined based on the fixed parameters A, C, D, α, β and γ and the variable parameter Y, the shift overdriving data P5 is generated for a grayscale value which is different from the grayscale value of each of the plurality of the overdriving data P11, P12, P13, P21, P22 and P23 and is inputted to determine the shift value Δx of the overdriving reference line BLY, the overdriving value is determined using the overdriving reference line and the shifted overdriving reference line, and the data voltage is generated based on the overdriving value. Thus, the overdriving value may be automatically determined according to the viewing angle X of the user so that the display quality of the display panel 100 may be enhanced.

The user may directly set the overdriving value so that the display quality may be set at a desired level or optimized and personalized to the user. The user may select the overdriving values three times, seven times, or nine times to set or optimize the display quality according to the exemplary embodiments.

For example, the user may set the first overdriving data P11 and the second overdriving data P21 in the first viewing angle (e.g. zero degree) and the user may set the shift overdriving data P5 in the first viewing angle (e.g. zero degree) so that the user may select the overdriving values three times to set or optimize the display quality.

In this exemplary embodiment, the fifth overdriving data P12, the sixth overdriving data P22 in the second viewing angle (e.g. twenty degree) may be determined by the operator 240 and the shift overdriving data (P5 at twenty degree, P5 at forty degree) may be determined by the operator 240.

For example, the user may set the first overdriving data P11 and the second overdriving data P21 in the first viewing angle (e.g. zero degree), the fifth overdriving data P12 and the sixth overdriving data P22 in the second viewing angle (e.g. twenty degree), the seventh overdriving data P13 and the eighth overdriving data P23 in the third viewing angle (e.g. forty degree) and the user may set the shift overdriving data P5 in the first viewing angle (e.g. zero degree) so that the user may select the overdriving values seven times to set or optimize the display quality.

In this exemplary embodiment, the shift overdriving data (P5 at twenty degree, P5 at forty degree) may be determined by the operator 240.

For example, the user may set the first overdriving data P11 and the second overdriving data P21 in the first viewing angle (e.g. zero degree), the fifth overdriving data P12 and the sixth overdriving data P22 in the second viewing angle (e.g. twenty degree), the seventh overdriving data P13 and the eighth overdriving data P23 in the third viewing angle (e.g. forty degree), the user may set the shift overdriving data P5 in the first viewing angle (e.g. zero degree), the user may set the shift overdriving data P5 in the second viewing angle (e.g. twenty degree) and the user may set the shift overdriving data P5 in the third viewing angle (e.g. forty degree) so that the user may select the overdriving values nine times to set or optimize the display quality.

According to the exemplary embodiments of the display apparatus and the method of driving the display apparatus, the overdriving value according to the viewing angle is automatically set so that the display quality of the display panel may be enhanced.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Further, the use of "may" when describing embodiments of the inventive concept refers to "one or more embodiments of the inventive concept." Also, the term "exemplary" is intended to refer to an example or illustration.

It will be understood that when an element or layer is referred to as being "on" or "adjacent to" another element or layer, it can be directly on or adjacent to the other element or layer, or one or more intervening elements or layers may be present. In contrast, when an element or layer is referred to as being "directly on" or "immediately adjacent to" another element or layer, there are no intervening elements or layers present.

As used herein, the terms "use," "using," and "used" may be considered synonymous with the terms "utilize," "utilizing," and "utilized," respectively.

The electronic or electric devices and/or any other relevant devices or components according to embodiments of the present disclosure described herein, such as, for example, a timing controller, a data driver, and a gate driver, may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of ordinary skill in the art should recognize that the functionality of various computing/electronic devices may be combined or integrated into a single computing/electronic device, or the functionality of a particular computing/electronic device may be distributed across one or more other computing/electronic devices without departing from the spirit and scope of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A display apparatus comprising:

a display panel configured to display an image;

a position detector configured to determine a position of a user;

a driving controller configured to generate an overdriving value according to a grayscale value of previous frame data and a grayscale value of present frame data;

a gate driver configured to output gate signals to the display panel; and a data driver configured to output data voltages to the display panel based on the overdriving value, wherein the driving controller is further configured to:

receive a plurality of overdriving data of a plurality of viewing angles;

determine a fixed parameter based on the plurality of overdriving data of the plurality of viewing angles, the fixed parameter being the same regardless of any one from among the plurality of viewing angles;

determine a viewing angle of the user based on the position of the user;

determine a variable parameter based on the fixed parameter and the viewing angle;

generate an overdriving reference line based on the fixed parameter and the variable parameter;

receive shift overdriving data generated for a grayscale value which is different from the grayscale value of each of the plurality of overdriving data;

determine a shift value of the overdriving reference line according to grayscale values based on the shift overdriving data; and generate the overdriving value based on the overdriving reference line and a shifted overdriving reference line.

2. The display apparatus of claim 1, wherein the driving controller comprises:

a position calculator configured to determine the viewing angle of the user based on the position of the user;

an operator configured to determine the fixed parameter and the variable parameter, generate the overdriving reference line, determine the shift value of the overdriving reference line and generate the overdriving value; and a memory configured to store an overdriving lookup table generated based on the overdriving reference line and the shifted overdriving reference line.

3. The display apparatus of claim 1, wherein the plurality of the overdriving data comprises:

a first overdriving data group measured in a first viewing angle when the grayscale value of the previous frame data is a first grayscale value;

a second overdriving data group measured in a second viewing angle when the grayscale value of the previous frame data is the first grayscale value; and a third overdriving data group measured in a third viewing angle when the grayscale value of the previous frame data is the first grayscale value.

4. The display apparatus of claim 3, wherein the plurality of the overdriving data further comprises a default overdriving data group measured regardless of the viewing angle when the grayscale value of the previous frame data is the first grayscale value.

5. The display apparatus of claim 1, wherein the driving controller is configured to determine the viewing angle of the user based on the position of the user in real time, and wherein the driving controller is configured to update the variable parameter, the overdriving reference line and the overdriving value based on the viewing angle of the user in real time.

6. A display apparatus comprising:

a display panel configured to display an image;

a position detector configured to determine a position of a user;

a driving controller configured to generate an overdriving value according to a grayscale value of previous frame data and a grayscale value of present frame data;

a gate driver configured to output gate signals to the display panel; and a data driver configured to output data voltages to the display panel based on the overdriving value, wherein the driving controller is further configured to:

receive a plurality of overdriving data of a plurality of viewing angles;

determine a fixed parameter based on the plurality of overdriving data of the plurality of viewing angles;

determine a viewing angle of the user based on the position of the user;

determine a variable parameter based on the fixed parameter and the viewing angle;

generate an overdriving reference line based on the fixed parameter and the variable parameter;

receive shift overdriving data generated for a grayscale value which is different from the grayscale value of each of the plurality of overdriving data;

determine a shift value of the overdriving reference line according to grayscale values based on the shift overdriving data; and generate the overdriving value based on the overdriving reference line and a shifted overdriving reference line, wherein the plurality of the overdriving data comprises:

a first overdriving data group measured in a first viewing angle when the grayscale value of the previous frame data is a first grayscale value;

a second overdriving data group measured in a second viewing angle when the grayscale value of the previous frame data is the first grayscale value;

a third overdriving data group measured in a third viewing angle when the grayscale value of the previous frame data is the first grayscale value; and a default overdriving data group measured regardless of the viewing angle when the grayscale value of the previous frame data is the first grayscale value, wherein the first overdriving data group comprises:

a first overdriving data measured in the first viewing angle when the grayscale value of the previous frame data is the first grayscale value and the grayscale value of the present frame data is a second grayscale value; and a second overdriving data measured in the first viewing angle when the grayscale value of the previous frame data is the first grayscale value and the grayscale value of the present frame data is a third grayscale value, wherein the default overdriving data group comprises:

a third overdriving data measured when the grayscale value of the previous frame data is the first grayscale value and the grayscale value of the present frame data is the first grayscale value; and a fourth overdriving data measured when the grayscale value of the previous frame data is the first grayscale value and the grayscale value of the present frame data is a maximum grayscale value.

7. The display apparatus of claim 6, wherein the overdriving reference line in the first viewing angle is defined as Polynomial 1, wherein the Polynomial 1 is $DOD-DPF=A(DCF)^3+B1(DCF)^2+C(DCF)+D$, where DOD is the overdriving value, DPF is the grayscale value of the previous frame data, and DCF is the grayscale value of the present frame data, wherein an operator is configured to determine parameters A, B1, C and D in the Polynomial 1 utilizing the first overdriving data, the second overdriving data, the third overdriving data, and the fourth overdriving data.

8. The display apparatus of claim 7, wherein the operator is configured to determine the parameters A, C and D in the Polynomial 1 as the fixed parameters.

9. The display apparatus of claim 8, wherein the second overdriving data group comprises:

a fifth overdriving data measured in the second viewing angle when the grayscale value of the previous frame data is the first grayscale value and the grayscale value of the present frame data is the second grayscale value; and a sixth overdriving data measured in the second viewing angle when the grayscale value of the previous frame data is the first grayscale value and the grayscale value of the present frame data is the third grayscale value, wherein the third overdriving data group comprises:

a seventh overdriving data measured in the third viewing angle when the grayscale value of the previous frame data is the first grayscale value and the grayscale value of the present frame data is the second grayscale value; and an eighth overdriving data measured in the third viewing angle when the grayscale value of the previous frame data is the first grayscale value and the grayscale value of the present frame data is the third grayscale value.

10. The display apparatus of claim 9, wherein the overdriving reference line in the second viewing angle is defined as Polynomial 2, wherein the Polynomial 2 is $DOD-DPF=A(DCF)^3+B2(DCF)^2+C(DCF)+D$, wherein the operator is configured to determine a parameter B2 of the Polynomial 2 utilizing the fifth overdriving data and the sixth overdriving data and the fixed parameters A, C and D in Polynomial 1, wherein the overdriving reference line in the third viewing angle is defined as Polynomial 3, wherein the Polynomial 3 is $DOD-DPF=A(DCF)^3+B3(DCF)^2+C(DCF)+D$, and wherein the operator is configured to determine a parameter B3 of the Polynomial 3 utilizing the seventh overdriving data and the eighth overdriving data and the fixed parameters A, C and D in Polynomial 1.

11. The display apparatus of claim 10, wherein the operator is further configured to determine parameters $\alpha$, $\beta$ and $\gamma$ representing relationships between the first viewing angle, B1 in the Polynomial 1, the second viewing angle, B2 in the Polynomial 2, the third viewing angle, and B3 in the Polynomial 3.

12. The display apparatus of claim 11, wherein the operator is further configured to determine the variable parameter according to the viewing angle utilizing Polynomial 4, wherein the Polynomial 4 is $Y=\alpha X^2+\beta X+\gamma$, and wherein Y is the variable parameter and X is the viewing angle.

13. The display apparatus of claim 6, wherein the driving controller comprises an operator, and the operator is configured to determine the shift value of the overdriving reference line based on the shift overdriving data measured in the first viewing angle when the grayscale value of the previous frame data is a fourth grayscale value and the grayscale value of the present frame data is a fifth grayscale value.

14. The display apparatus of claim 6, wherein the driving controller comprises an operator, and the operator is configured to determine the shift value of the overdriving reference line based on a first shift overdriving data, a second shift overdriving data, and a third shift overdriving data, wherein the first shift overdriving data is measured in the first viewing angle when the grayscale value of the previous frame data is a fourth grayscale value and the grayscale value of the present frame data is a fifth grayscale value, wherein the second shift overdriving data is measured in the second viewing angle when the grayscale value of the previous frame data is the fourth grayscale value and the grayscale value of the present frame data is the fifth grayscale value, and wherein the third shift overdriving data is measured in the third viewing angle when the grayscale value of the previous frame data is the fourth grayscale value and the grayscale value of the present frame data is the fifth grayscale value.

15. A method of driving a display apparatus, the method comprising:

determining a fixed parameter based on a plurality of overdriving data of a plurality of viewing angles, the fixed parameter being the same regardless of any one from among the plurality of viewing angles;

determining a position of a user with respect to a display panel;

determining a viewing angle of the user based on the position of the user;

determining a variable parameter based on the fixed parameter and the viewing angle;

generating an overdriving reference line based on the fixed parameter and the variable parameter;

determining a shift value of the overdriving reference line according to grayscale values based on shift overdriving data generated for a grayscale value which is different from the grayscale value of each of the plurality of overdriving data;

generating an overdriving value based on the overdriving reference line and a shifted overdriving reference line;

generating a data voltage based on the overdriving value; and outputting the data voltage to the display panel.

16. The method of claim 15, wherein the plurality of overdriving data comprises:

a first overdriving data group measured in a first viewing angle when the grayscale value of a previous frame data is a first grayscale value;

a second overdriving data group measured in a second viewing angle when the grayscale value of the previous frame data is the first grayscale value;

a third overdriving data group measured in a third viewing angle when the grayscale value of the previous frame data is the first grayscale value; and a default overdriving data group measured regardless of the viewing angle when the grayscale value of the previous frame data is the first grayscale value.

17. The method of claim 16, wherein the first overdriving data group comprises:

a first overdriving data measured in the first viewing angle when the grayscale value of the previous frame data is the first grayscale value and the grayscale value of a present frame data is a second grayscale value; and a second overdriving data measured in the first viewing angle when the grayscale value of the previous frame data is the first grayscale value and the grayscale value of the present frame data is a third grayscale value, and wherein the default overdriving data group comprises:

a third overdriving data measured when the grayscale value of the previous frame data is the first grayscale value and the grayscale value of the present frame data is the first grayscale value; and a fourth overdriving data measured when the grayscale value of the previous frame data is the first grayscale value and the grayscale value of the present frame data is a maximum grayscale value.

18. The method of claim 17, wherein the overdriving reference line in the first viewing angle is defined as Polynomial 1, wherein the Polynomial 1 is $DOD-DPF=A(DCF)^3+B1(DCF)^2+C(DCF)+D$, where DOD is the overdriving value, DPF is the grayscale value of the previous frame data, and DCF is the grayscale value of the present frame data, wherein parameters A, B1, C and D in the Polynomial 1 are determined utilizing the first overdriving data, the second overdriving data, the third overdriving data, and the fourth overdriving data.

19. The method of claim 18, wherein the second overdriving data group comprises:

a fifth overdriving data measured in the second viewing angle when the grayscale value of the previous frame data is the first grayscale value and the grayscale value of the present frame data is the second grayscale value; and a sixth overdriving data measured in the second viewing angle when the grayscale value of the previous frame data is the first grayscale value and the grayscale value of the present frame data is the third grayscale value, wherein the third overdriving data group comprises:

a seventh overdriving data measured in the third viewing angle when the grayscale value of the previous frame data is the first grayscale value and the grayscale value of the present frame data is the second grayscale value; and an eighth overdriving data measured in the third viewing angle when the grayscale value of the previous frame data is the first grayscale value and the grayscale value of the present frame data is the third grayscale value, wherein the overdriving reference line in the second viewing angle is defined as Polynomial 2, wherein the Polynomial 2 is $DOD-DPF=A(DCF)^3+B2(DCF)^2+C(DCF)+D$, wherein a parameter B2 of the Polynomial 2 is determined utilizing the fifth overdriving data and the sixth overdriving data and the fixed parameters A, C and D in Polynomial 1, wherein the overdriving reference line in the third viewing angle is defined as Polynomial 3, wherein the Polynomial 3 is $DOD-DPF=A(DCF)^3+B3(DCF)^2+C(DCF)+D$, and wherein a parameter B3 of the Polynomial 3 is determined utilizing the seventh overdriving data and the eighth overdriving data and the fixed parameters A, C and D in Polynomial 1.

20. The method of claim 19, wherein the variable parameter according to the viewing angle is determined utilizing Polynomial 4, wherein the Polynomial 4 is $Y=\alpha X^2+\beta X+\gamma$, and where Y is the variable parameter and X is the viewing angle, parameters $\alpha$, $\beta$ and $\gamma$ represent relationships between the first viewing angle, B1 in the Polynomial 1, the second viewing angle, B2 in the Polynomial 2, the third viewing angle, and B3 in the Polynomial 3.

* * * * *